US006457271B1

(12) United States Patent
Vaid et al.

(10) Patent No.: US 6,457,271 B1
(45) Date of Patent: Oct. 1, 2002

(54) MAGAZINE SAFETY

(75) Inventors: Pardip K. Vaid, Northampton; Jason M. Pinsonnault, Palmer, both of MA (US); Hubert Krieger, Langenpreising (DE); Horst Wesp, Steyr (AT)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/749,135

(22) Filed: Dec. 27, 2000

(51) Int. Cl.[7] ..... F41A 17/38
(52) U.S. Cl. ..... 42/70.02; 42/11
(58) Field of Search ..... 42/70, 70.01, 70.02, 42/70.05, 70.08; 89/137, 144, 147, 148, 150, 154, 195, 196

(56) References Cited

U.S. PATENT DOCUMENTS 4,031,648 A 6/1977 Thomas
4,291,481 A 9/1981 Hillberg
4,420,899 A * 12/1983 Bourlet et al. ..... 42/70
4,428,138 A 1/1984 Seecamp
4,619,062 A * 10/1986 Johnson ..... 42/70.11
5,225,612 A * 7/1993 Bernkrant ..... 42/70.02
5,438,784 A * 8/1995 Lenarski et al. ..... 42/70.02
5,704,153 A 1/1998 Kaminski et al.
6,240,669 B1 * 6/2001 Spaniel et al. ..... 42/70.02

* cited by examiner

*Primary Examiner*—Charles T. Jordan
*Assistant Examiner*—Bret Hayes
(74) *Attorney, Agent, or Firm*—McCormick, Paulding & Huber LLP

(57) ABSTRACT

A magazine safety is provided for a semi-automatic firearm having a frame with a magazine well, a magazine, and a firing mechanism that includes a trigger bar. The magazine safety includes a latch and a latch bias. When the magazine is not received within the magazine well, the latch bias biases the latch into engagement with the trigger bar, thereby preventing the actuation of the firing mechanism via the trigger bar. Inserting the magazine completely into the magazine well causes the magazine to disengage the latch from the trigger bar, thereby preventing the latch from impeding movement of the trigger bar.

17 Claims, 1 Drawing Sheet

MAGAZINE SAFETY

BACKGROUND OF THE INVENTION

1. Technical Field

This invention relates to firearms in general, and to magazine safeties for firearms in particular.

2. Background Information

Semi-automatic pistols typically include an ammunition magazine disposed in the handle portion of the pistol's frame. Rounds of ammunition stored in the magazine are individually fed from the magazine into a firing chamber, where each round is fired. The magazine can be manually installed and removed from the firearm by the operator. Many gun manufacturers offer firearms that include a magazine safety that prevents the firearm from being fired if the magazine is not fully received within the magazine well. The magazine safety is principally designed to provide an additional safety mechanism to ensure that the firearm is safe regardless of whether the magazine is installed within the firearm or removed from the firearm.

DISCLOSURE OF THE INVENTION

According to the present invention, a magazine safety is provided for a semi-automatic firearm having a frame with a magazine well, a magazine, a slide, and a firing mechanism that includes a trigger bar. The magazine safety includes a latch and a latch bias. When the magazine is not received within the magazine well, the latch bias biases the latch into engagement with the trigger bar, thereby preventing the actuation of the firing mechanism via the trigger bar. Inserting the magazine completely into the magazine well causes the magazine to engage the latch and cause the latch to disengage the trigger bar, thereby preventing the latch from impeding movement of the trigger bar.

An advantage of the present invention is that the operating safety of the firearm is appreciably enhanced. The present invention safety provides an additional safety to ensure that the firearm is safe regardless of whether the magazine is installed within the firearm or removed from the firearm. A further advantage of the present invention is that the magazine safety is automatically engaged when the magazine is removed from the magazine well.

These and other objects, features, and advantages of the present invention will become apparent in light of the detailed description of the present invention.

DETAILED DESCRIPTION OF THE INVENTION

Figure 1:
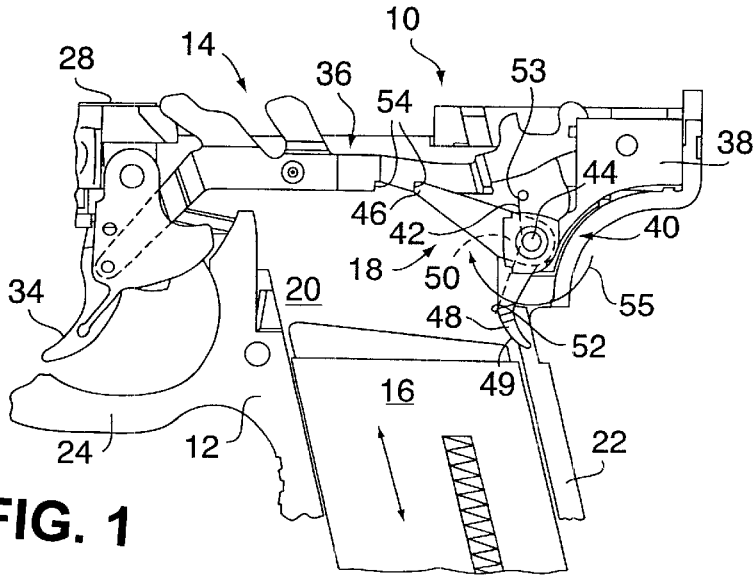
FIG. 1 is a diagrammatic assembly of a semi-automatic firearm partially sectioned, showing the present magazine safety in the engaged mode.

Referring to FIG. 1, a semi-automatic firearm 10 includes a frame 12, a firing mechanism 14, a slide assembly (not shown), a magazine 16, and a magazine safety 18. The frame 12 includes a magazine well 20 for receiving the magazine

16, a handle portion 22, a trigger guard 24, and a pair of guide rails 28. The magazine well 20 is disposed in the handle portion 22. The guide rails 28 support and guide the slide along the frame 12. The slide assembly includes a firing chamber and a barrel (not shown) through which the projectile portion of a round of ammunition travels. The firing mechanism 14 includes a pivotly mounted trigger 34, a trigger bar 36, and a primer contacting mechanism 38. The trigger bar 36 operably connects the trigger 34 and the primer contacting mechanism 38 such that actuating the trigger 34 under normal unsafe operating conditions causes the primer contacting mechanism 38 to be actuated. The primer contacting mechanism 38 can be any mechanism actuable by a trigger bar 36 that directly or indirectly causes the round of ammunition residing within the firing chamber to be fired. Primer contacting mechanisms 38 include, but are not limited to, hammer-type and striker pin-type percussion assemblies. The present invention safety can also be used with firearms that utilize a trigger bar 36 with an electronic type firing mechanism.

Figure 3:
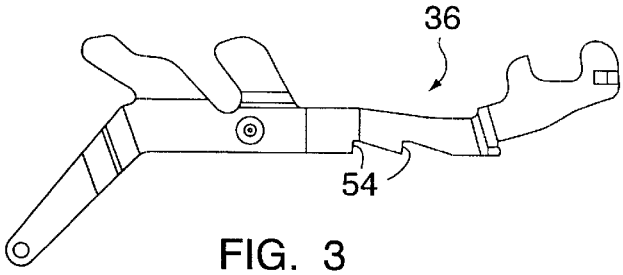
FIG. 3 is a diagrammatic view of one embodiment of the latch portion of the present invention.
Figure 4:
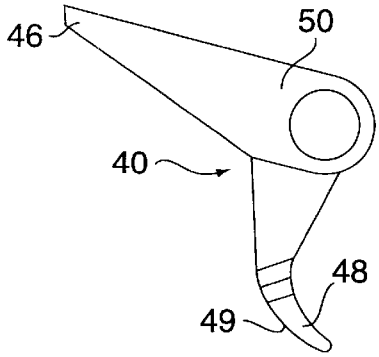
FIG. 4 is a diagrammatic assembly of a semi-automatic firearm partially sectioned, showing the present magazine safety in the disengaged mode.

Referring to FIGS. 1, 3, and 4, the magazine safety 18 includes a latch 40 and a latch bias 42. In the most preferred embodiment (shown in FIGS. 1, 3, and 4), the latch 40 is a member pivotly mounted within the frame 12 in the upper region of the handle portion 22. In alternative embodiments, the latch may be slidably mounted within the frame in a manner that permits the latch to engage the trigger bar 36; e.g., a plunger-type device. In the embodiment shown in FIGS. 1 and 4, the latch 40 is pivotable about a pin 44 extending side to side within the frame 12. The latch 40 includes a catch 46, a spur 48, and a midportion 50 extending between the catch 46 and the spur 48. The pin 44, which extends through the midportion 50, defines the pivot point around which the latch 40 pivots. The latch bias 42 is a spring having a first end 52 acting on the spur 48, and a second end 53 acting on the frame 12. The latch bias 42 biases the latch 40 toward the trigger bar 36. The latch bias 42 is not limited to the above described spring embodiment, and alternatively can be any type of bias that is capable of biasing the latch 40 toward the trigger bar 36. The spur 48 has a cam-like contact surface 49 that allows for non-binding interaction with the magazine 16 as will be explained below. The contact surface 49 and the latch bias 42 also each provide a means for adjusting the nature of the contact between the magazine and the latch; i.e., the "feel" of the magazine being inserted into the magazine well. For example, a sharper sloped contact surface 49 vis-a-vis the magazine 16 and/or a latch bias 42 with a higher spring rate can make the insertion of the magazine "feel" stiffer. In addition, a longer spur contact surface 49 can change the nature of the contact or "feel" by increasing the distance that the spur 48 and the magazine 16 are in contact with one another during movement of the magazine within the magazine well.

Referring to FIG. 1, when the magazine 16 is not completely received within the magazine well 20, the latch bias 42 biases the latch 40 in the direction shown by arrow 55, thereby causing the spur 48 to travel a distance into the magazine well 20 and the latch 40 into engagement with the trigger bar 36. The engagement between the trigger bar 36 and the latch 40 prevents movement of the trigger bar 36 adequate to actuate the primer contacting mechanism 38. The manner of engagement between the latch 40 and the trigger bar 36 can be adapted to the firearm at hand, and more specifically, can be adapted to the primer contacting mechanism 38 at hand. FIGS. 1 and 4, for example, partially show a striker-type primer contacting mechanism 38 operably connected to the trigger 34 by the trigger bar 36.

Figure 2:
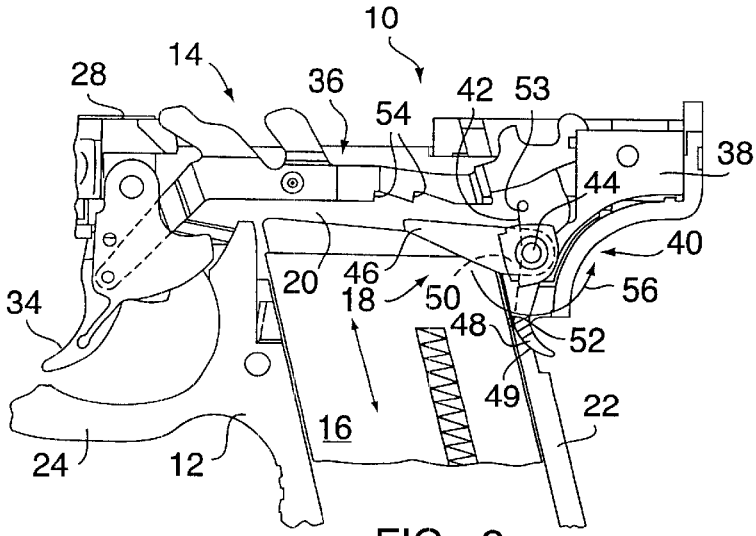
FIG. 2 is a diagrammatic view of one embodiment of the trigger bar of the present invention magazine safety.

In the embodiment of the present magazine safety shown in FIGS. 1, 2, and 4, the trigger bar 36 includes one or more notches 54 shaped and positioned to receive the catch 46. A trigger bar 36 with one notch 54 is typically used with a single action firearm and a trigger bar 36 with two notches 54 is typically used with a double action firearm. In the case of a double action firearm, one notch 54 is positioned to provide the safety mechanism if the firearm is in single action mode, and the other notch 54 is positioned to provide the safety mechanism if the firearm is in double action mode. When the magazine 16 is removed from the magazine well 20, the latch 40 becomes engaged with the trigger bar 36 when the catch 46 is received within the notch 54. Any attempt to actuate the primer contacting mechanism 38 via the trigger 34 (i.e., fire the firearm) is prevented by the engagement between the latch 40 and the trigger bar 36.

Now referring to FIG. 4, when the magazine 16 is inserted a distance into the magazine well 20, the magazine 16 will contact the spur 48. As the magazine 16 is inserted further into the magazine well 20, the magazine 16 will contact the spur 48 and cause the latch 40 to rotate in the direction shown by arrow 56. Rotation of the latch 40 causes the latch 40 to disengage from the trigger bar 36. In the preferred embodiment, the disengagement occurs when the catch 46 is removed from the notch 54 disposed in the trigger arm 36. The spur 48 is subsequently biased against the magazine 16 and the latch 40 is maintained in a disengaged position. Once the latch 40 is disengaged, it no longer impedes translation of the trigger bar 36 and therefore actuation of the primer contacting mechanism 38 via the trigger 34. As stated above, the manner of engagement between the latch 40 and the trigger bar 36 can be adapted to the firearm at hand. For example, in some instances the translation path of the trigger bar 36 includes linear and non-linear portions. In such cases, the notch(es) 54 and the catch 46 are shaped in a manner to allow engagement during such motion.

Although this invention has been shown and described with respect to the detailed embodiments thereof, it will be understood by those skilled in the art that various changes in form and detail thereof may be made without departing from the spirit and scope of the invention. For example, it is intended that the present invention be used as a magazine safety. However, it is possible that in some instances there may be advantage in using the present invention in an application where something other than a magazine is used to actuate the latch portion of the present safety.

What is claimed is:

1. A magazine safety for a semi-automatic firearm having a frame with a magazine well, a magazine, and a firing mechanism that includes a trigger bar, said magazine safety comprising:

a latch mounted in said frame; and a latch bias;

wherein when said magazine is not received within said magazine well, said latch bias biases said latch into engagement with said trigger bar, thereby preventing movement of said trigger bar;

wherein inserting said magazine completely into said magazine well, causes said magazine to disengage said latch from said trigger bar, thereby preventing said latch from impeding said movement of said trigger bar.

2. The magazine safety of claim 1, wherein said latch comprises:

a catch;

a spur; and a midportion extending between said catch and said spur;

wherein said latch is pivotly mounted in said frame about said midportion; and wherein inserting said magazine completely into said magazine well, causes said magazine to contact said spur and rotate said catch out of engagement with said trigger bar, thereby preventing said catch from impeding movement of said trigger bar.

3. The magazine safety of claim 2, wherein said trigger bar includes a notch, and wherein when said latch is engaged with said trigger bar, said catch is received in said notch.

4. The magazine safety of claim 2 wherein said trigger bar includes a first notch and a second notch, and wherein when said latch is engaged with said trigger bar, said catch is received in one of said first notch or said second notch.

5. The magazine safety of claim 4, wherein said firearm is operable in a single action mode or a double-action mode, and when said magazine is not received within said magazine well and said firearm is in said double action mode, said catch is received within one of said first notch or said second notch, and when said magazine is not received within said magazine well and said firearm is in said single action mode, said catch is received within the other of said first notch or said second notch.

6. The magazine safety of claim 2, wherein said magazine safety further comprises a means for adjusting the nature of said contact between said latch and said magazine.

7. The magazine safety of claim 2, wherein said firearm is a single action type.

8. The magazine safety of claim 1, wherein said firearm is a single action type.

9. The magazine safety of claim 1 wherein said trigger bar includes a first notch and a second notch, and wherein when said latch is engaged with said trigger bar, said latch is received in one of said first notch or said second notch.

10. The magazine safety of claim 1, wherein said magazine safety further comprises a means for adjusting the nature of said contact between said latch and said magazine.

11. A magazine safety for a semi-automatic firearm having a frame with a magazine well, a magazine, and a firing mechanism that includes a trigger bar, said magazine safety comprising:

a latch having a catch, a spur, and a midportion extending between said catch and said spur, said latch pivotly mounted in said frame about said midportion; and a latch bias;

wherein when said magazine is not received within said magazine well, said latch bias biases said spur into said magazine well and said catch into engagement with said trigger bar, thereby preventing movement of said trigger bar;

wherein inserting said magazine completely into said magazine well, causes said magazine to contact said spur and rotate said catch out of engagement with said trigger bar, thereby preventing said catch from impeding said movement of said trigger bar.

12. A safety for a semi-automatic firearm having a frame, a magazine, and a firing mechanism that includes a trigger bar, said safety comprising:

an insertable member that can be selectively received within a cavity disposed in said frame;

a latch mounted in said frame; and a latch bias;

wherein when said insertable member is not received within said cavity, said latch bias biases said latch into engagement with said trigger bar, thereby preventing movement of said trigger bar;

wherein inserting said insertable member completely into said cavity causes said insertable member to disengage said latch from said trigger bar, thereby preventing said latch from impeding movement of said trigger bar.

13. The safety of claim 12, wherein said latch comprises:

a catch;

a spur; and a midportion extending between said catch and said spur;

wherein said latch is pivotly mounted in said frame about said midportion; and wherein inserting said insertable member completely into said magazine well, causes said insertable member to rotate said latch out of engagement with said trigger bar, thereby preventing said latch from impeding movement of said trigger bar.

14. The safety of claim 13, wherein said trigger bar includes a notch, and wherein when said latch is engaged with said trigger bar, said catch is received in said notch.

15. A semi-automatic firearm, comprising:

a firing mechanism having a trigger and a trigger bar;

a magazine;

a frame with a magazine well for receiving said magazine; and a latch mounted in said frame; and a latch bias;

wherein when said magazine is not received within said magazine well, said latch bias biases said latch into engagement with said trigger bar, thereby preventing movement of said trigger bar; and wherein inserting said magazine completely into said magazine well causes said magazine to disengage said latch from said trigger bar, thereby preventing said latch from impeding said movement of said trigger bar.

16. The semi-automatic firearm of claim 15, wherein said latch comprises:

a catch;

a spur; and a midportion extending between said catch and said spur;

wherein said latch is pivotly mounted in said frame about said midportion; and wherein inserting said magazine completely into said magazine well, causes said magazine to contact said spur and rotate said catch out of engagement with said trigger bar, thereby preventing said catch from impeding movement of said trigger bar.

17. The semi-automatic firearm of claim 16, wherein said trigger bar includes a notch, and wherein when said latch is engaged with said trigger bar, said catch is received in said notch.

* * * * *